US008839768B2

(12) United States Patent
Kim et al.

(10) Patent No.: US 8,839,768 B2
(45) Date of Patent: Sep. 23, 2014

(54) CANISTER FOR VEHICLES AND FUEL EVAPORATIVE SYSTEM PROVIDED WITH THE SAME

(75) Inventors: Myeong Hwan Kim, Hwaseong-si (KR); Buyeol Ryu, Hwaseong-si (KR); Pil Seon Choi, Suwon (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 662 days.

(21) Appl. No.: 13/194,678

(22) Filed: Jul. 29, 2011

(65) Prior Publication Data

US 2012/0118273 A1 May 17, 2012

(30) Foreign Application Priority Data

Nov. 12, 2010 (KR) ..... 10-2010-0113011

(51) Int. Cl.
*F02M 33/02* (2006.01)
*F02M 25/08* (2006.01)
*F02M 33/06* (2006.01)

(52) U.S. Cl.
CPC ..... *F02M 25/0854* (2013.01); *F02M 25/08* (2013.01); *F02M 33/02* (2013.01); *F02M 33/06* (2013.01)
USPC ..... 123/520

(58) Field of Classification Search
CPC ... F02M 25/08; F02M 25/0854; F02M 33/02; F02M 33/06
USPC ..... 123/520, 518, 519, 543, 549, 556
See application file for complete search history.

(56) References Cited

U.S. PATENT DOCUMENTS

| | | | | | |
|---|---|---|---|---|---|
| 4,721,846 | A * | 1/1988 | Lupoli et al. | ..... | 219/206 |
| 5,632,251 | A * | 5/1997 | Ishikawa | ..... | 123/519 |
| 5,687,697 | A * | 11/1997 | Ishikawa | ..... | 123/520 |
| 6,701,902 | B2 * | 3/2004 | Koyama et al. | ..... | 123/519 |
| 6,823,851 | B2 * | 11/2004 | Amano et al. | ..... | 123/520 |
| 7,513,244 | B2 | 4/2009 | Potier | | |

FOREIGN PATENT DOCUMENTS

| | | | |
|---|---|---|---|
| JP | 1-147154 | A | 6/1989 |
| JP | 5-223024 | A | 8/1993 |
| JP | 2004-68696 | A | 3/2004 |
| JP | 2007-046893 | A | 2/2007 |
| JP | 2009-156030 | A | 7/2009 |

* cited by examiner

*Primary Examiner* — Hieu T Vo
(74) *Attorney, Agent, or Firm* — Morgan, Lewis & Bockius LLP

(57) ABSTRACT

A canister for a vehicle is provided with charcoal therein so as to absorb evaporation gas evaporated at a fuel tank, supplies air by pressure difference formed due to engine purge, and thereby releases the absorbed evaporation gas so as to supply the evaporation gas to an engine and to be burned therein again. The canister may include an evaporation gas supply passage connected to the fuel tank and receiving the evaporation gas, an air passage selectively receiving the air from the exterior, a purge passage supplying the evaporation gas to the engine according to flow of the supplied air, and a heating module heating a position at which the air passing through the air passage flows in the canister, or mounted at the air passage and heating the air flowing in the canister, wherein the heating module comprises a heating core for heating the air flowing in the canister, and a diffusing plate disposed between the air passage and the heating module and diffusing the air passing through the air passage so as to be heated at the heating core evenly.

20 Claims, 13 Drawing Sheets

CANISTER FOR VEHICLES AND FUEL EVAPORATIVE SYSTEM PROVIDED WITH THE SAME

CROSS-REFERENCE TO RELATED APPLICATION

This application claims priority to and the benefit of Korean Patent Application No. 10-2010-0113011 filed Nov. 12, 2010, the entire contents of which application is incorporated herein for all purposes by this reference.

BACKGROUND OF INVENTION

1. Field of Invention

The present invention relates to a canister for a vehicle and a fuel evaporative system provided with the same, and more particularly to a canister for a vehicle and a fuel evaporative system provided with the same which is applied mainly to a vehicle in which an operation (purge) region of an engine is reduced (i.e., hybrid vehicle) and which can reduce generation of evaporation gas in spite of small purge amount.

2. Description of Related Art

The automotive industry has actively sought to reduce pollutants in emissions. Exhaust gas is largely divided into tail pipe emission flowing out to the atmosphere after engine combustion and evaporative emission flowing out to the atmosphere due to evaporation of gasoline at a fuel system of a vehicle such as a fuel tank. One method for improving evaporative emission is using a canister.

Generally, gasoline includes a mixture of hydrocarbons ranging from higher volatility butanes (C4) to lower volatility C8 to C10 hydrocarbons. Such gasoline is filled in a fuel tank. However, when the temperature of the surroundings is high or vapor pressure in the fuel tank is increased by movement of the vapor, fuel vapor leaks through crevices of the fuel tank. To prevent leakage of the fuel vapor, the fuel vapor is vented into a canister when the vapor pressure in the fuel tank is increased.

The canister has absorbent material (e.g., charcoal) for absorbing the fuel vapor from the fuel tank storing volatility fuel. If the hydrocarbons HC absorbed by the canister are vented into the atmosphere, the engine does not meet exhaust gas regulations. Therefore, an engine control unit operates a purge control solenoid valve in order to vent the hydrocarbons absorbed by the canister into the engine.

The evaporation gas is physically or chemically absorbed at the charcoal of the canister.

Physical absorption means that the evaporation gas is absorbed to the charcoal by Van der Waal's force that acts between molecules. Since physical absorption in which electron transfer between an adsorbate and an absorbent does not occur is reversible reaction, release may be easy, absorbing speed may be fast, and the physical absorption occurs well at low temperature.

Chemical absorption occurs by sharing electrons between the adsorbate and the absorbent. Since chemical absorption is non-reversible reaction, release may not be easy and absorbing speed may be slow.

Both of chemical absorption and physical absorption are exothermic reaction.

The evaporation gas absorbed at the charcoal is released by air supplied to the canister. Since release reaction is endothermic reaction, the release reaction occurs better at higher air temperature.

The evaporation gas absorbed at the charcoal of the canister can be diffused to the atmosphere. If canister temperature rises, C4 and C5 which are low molecular materials among ingredients of the evaporation gas absorbed at the charcoal near an evaporation gas supply passage are diffused to near an air passage and are absorbed at the charcoal near the air passage. After that, if the canister temperature rises again, low molecular materials absorbed at the charcoal near the air passage are leaked through the air passage. These phenomena are called bleed emission.

Meanwhile, a hybrid vehicle is provided with an engine outputting power by combustion of fuel and a motor outputting power of a battery. Recently, uses of the engine are declining for enhancement of fuel economy, and accordingly it is also declining that the fuel vapor of the canister is released and is burned again. Since the fuel vapor absorbed in the canister increases but the fuel vapor purged from the engine decreases, overflow of the fuel vapor may occur.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Various aspects of the present invention provide for a canister for a vehicle and a fuel evaporative system provided with the same having advantages of preventing overflow of fuel vapor and improving fuel economy.

Various aspects of the present invention reduce occurrence of bleed emission.

A canister for a vehicle according to various aspects of the present invention is provided with charcoal therein so as to absorb evaporation gas evaporated at a fuel tank, supplies air by pressure difference formed due to engine purge, and thereby releases the absorbed evaporation gas so as to supply the evaporation gas to an engine and to be burned therein again.

The canister may include an evaporation gas supply passage connected to the fuel tank and receiving the evaporation gas, an air passage selectively receiving the air from the exterior, a purge passage supplying the evaporation gas to the engine according to flow of the supplied air, and a heating module heating a position at which the air passing through the air passage flows in the canister, or mounted at the air passage and heating the air flowing in the canister, wherein the heating module comprises a heating core for heating the air flowing in the canister, and a diffusing plate disposed between the air passage and the heating module and diffusing the air passing through the air passage so as to be heated at the heating core evenly.

The diffusing plate may be a thin plate, and a plurality of diffusing holes may be formed at the diffusing plate.

The heating core may include a positive temperature coefficient (PTC) assembly generating heat according to supply of electricity, and a fin having a surface fixed to the PTC assembly, and heating the air flowing into the canister by transferring heat generated at the PTC assembly to the air.

The fin may be fixed to the PTC assembly by thermally conductive adhesive.

The PTC assembly may include a hollow rod formed of an inner space therein, a PTC element inserted in the inner space and generating heat according to the supply of the electricity, and a first terminal mounted in the inner space, and adapted to contact with the PTC element and supply the electricity to the PCT element.

The PTC assembly may be insertedly mounted in a receiving recess formed at a PTC frame.

An insulator may be mounted between the first terminal and the hollow rod.

The heating core may further include a second terminal fixed to the other surface of the fin and corresponding to the first terminal.

According to other aspects, the heating core may further include a second terminal mounted at an opposite side of the first terminal with reference to the PTC element in the inner space, and may be adapted to contact with the PTC element.

Diameter of an outlet may be larger than that of an inlet in the air passage.

The diffusing plate and the heating module may be replaceably mounted in a case formed at an upper end of one side of the canister and connected to the air passage.

The canister may further include a case cover, wherein one surface of the case is open, and the case cover is detachably coupled to the opened one surface such that the diffusing plate and the heating module are pulled out from the case through the opened one surface.

A fuel evaporative system according to various aspects of the present invention may include a fuel tank connected to a refueling line so as to receive fuel, exhausting internal evaporation gas through a evaporation gas line, and supplying the fuel through a fuel supply line, an engine connected to the fuel supply line so as to receive the fuel from fuel tank, and connected to an intake passage so as to receive air, a purge line connected to the intake passage, and a canister provided with charcoal therein for absorbing evaporation gas, and having an evaporation gas supply passage connected to the evaporation gas line so as to receive the evaporation gas, an air passage connected to an air supply line so as to receive exterior air, a purge passage connected to the purge line and releasing the evaporation gas absorbed at the charcoal according to flow of the air supplied through the air passage so as to supply the evaporation gas to the intake passage, and a heating module heating a position into which the air passing through the air passage flows or mounted at the air supply line and heating the air, wherein the heating module comprises a heating core for heating the air flowing in the canister, and a diffusing plate disposed between the air passage and the heating module and diffusing the air passing through the air passage so as to be heated at the heating core evenly.

The diffusing plate may be a thin plate, and a plurality of diffusing holes may be formed at the diffusing plate.

The heating core may include a positive temperature coefficient (PTC) assembly generating heat according to supply of electricity, and a fin having a surface fixed to the PTC assembly, and heating the air flowing into the canister by transferring heat generated at the PTC assembly to the air.

The fin may be fixed to the PTC assembly by thermally conductive adhesive.

The PTC assembly may include a hollow rod formed of an inner space therein, a PTC frame inserted in the inner space and formed of a receiving recess, a PTC element inserted mounted in the receiving recess and generating heat according to the supply of the electricity, and a first terminal mounted in the inner space, and adapted to contact with the PTC element and supply the electricity to the PCT element.

An insulator may be mounted between the first terminal and the hollow rod.

The heating core may further include a second terminal fixed to the other surface of the fin and corresponding to the first terminal.

According to other aspects, the heating core may further include a second terminal mounted at an opposite side of the first terminal with reference to the PTC element in the inner space, and may be adapted to contact with the PTC element.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
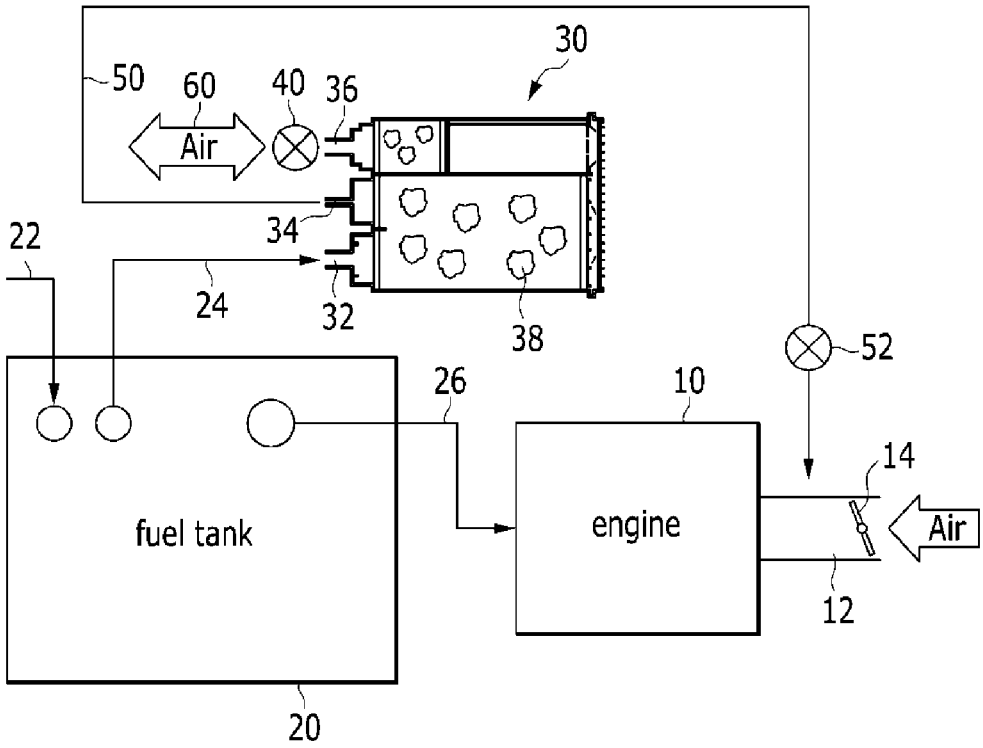
FIG. 1 is a schematic diagram of an exemplary fuel evaporative system according to various embodiments of the present invention.

As shown in FIG. 1, a fuel evaporative system according to various embodiments of the present invention includes an engine 10, a fuel tank 20, and a canister 30.

The engine 10 burns fuel and air so as to generate power for driving a vehicle, and includes an intake manifold for receiving the air and the fuel and an exhaust manifold for exhausting exhaust gas generated at combustion. The intake manifold is connected to an intake passage 12 so as to receive exterior air.

In addition, a throttle valve 14 is mounted at the intake passage 12 so as to control air amount supplied to the intake manifold.

The fuel tank 20 stores the fuel and is connected to the engine 10 through a fuel supply line 26 so as to supply the fuel to the engine 10. The fuel tank 20 is connected to a refueling line 22 so as to receive the fuel. In addition, the fuel tank 20 is connected to the canister 30 through an evaporation gas line 24 so as to supply evaporation gas generated at the fuel tank 20 to the canister 30. In this specification, the evaporation gas means fuel vapor.

The canister 30 absorbs the evaporation gas of the fuel tank 20 and releases the evaporation gas according to control of a control portion so as to supply it to the engine 10. For this purpose, the canister 30 is provided with a charcoal 38 therein. The charcoal 38 is formed with a plurality of micropores, and the evaporation gas is absorbed in the plurality of micropores. In addition, the canister 30 includes an evaporation gas supply passage 32, a purge passage 34, and an air passage 36.

The evaporation gas supply passage 32 is connected to the evaporation gas line 24 so as to receive the evaporation gas of the fuel tank 20. The evaporation gas supplied into the canister 30 through the evaporation gas supply passage 32 is absorbed at the charcoal 38.

The purge passage 34 is connected to a purge line 50, and the purge line 50 is connected to the intake passage 12 downstream of the throttle valve 14. The purge passage 34 selectively supplies the evaporation gas in the canister 30 to the engine 10 through the purge line 50 and the intake passage 12.

The air passage 36 is connected to an air supply line 60 so as to selectively receive the exterior air. If the exterior air is supplied into the canister 30 through the air passage 36 due to difference between negative pressure generated at the intake passage 12 downstream of the throttle valve 14 and atmospheric pressure at the air passage 36, the evaporation gas absorbed at the charcoal 38 is released and the released evaporation gas is supplied to the intake passage 12 together with the air supplied into the canister 30. That is, the evaporation gas of the canister 30 is supplied to the engine 10 according to a flow of the air received through the air passage 36, and the evaporation gas is exhausted as an exhaust gas after burned again in the engine 10.

Meanwhile, the fuel evaporative system according to various embodiments of the present invention may further include a canister close valve 40 mounted at the air supply line 60 and a purge control solenoid valve 52 mounted at the purge line 50.

The canister close valve 40 controls air supply to the canister 30 through the air supply line 60, and the purge control solenoid valve 52 controls supply of the evaporation gas from the canister 30 to the intake passage 12 through the purge line 50. The canister close valve 40 and the purge control solenoid valve 52 can be simultaneously controlled by the control portion. That is, if the canister close valve 40 is open, the purge control solenoid valve 52 is also open, and if the canister close valve 40 closes, the purge control solenoid valve 52 also closes.

Figure 2:
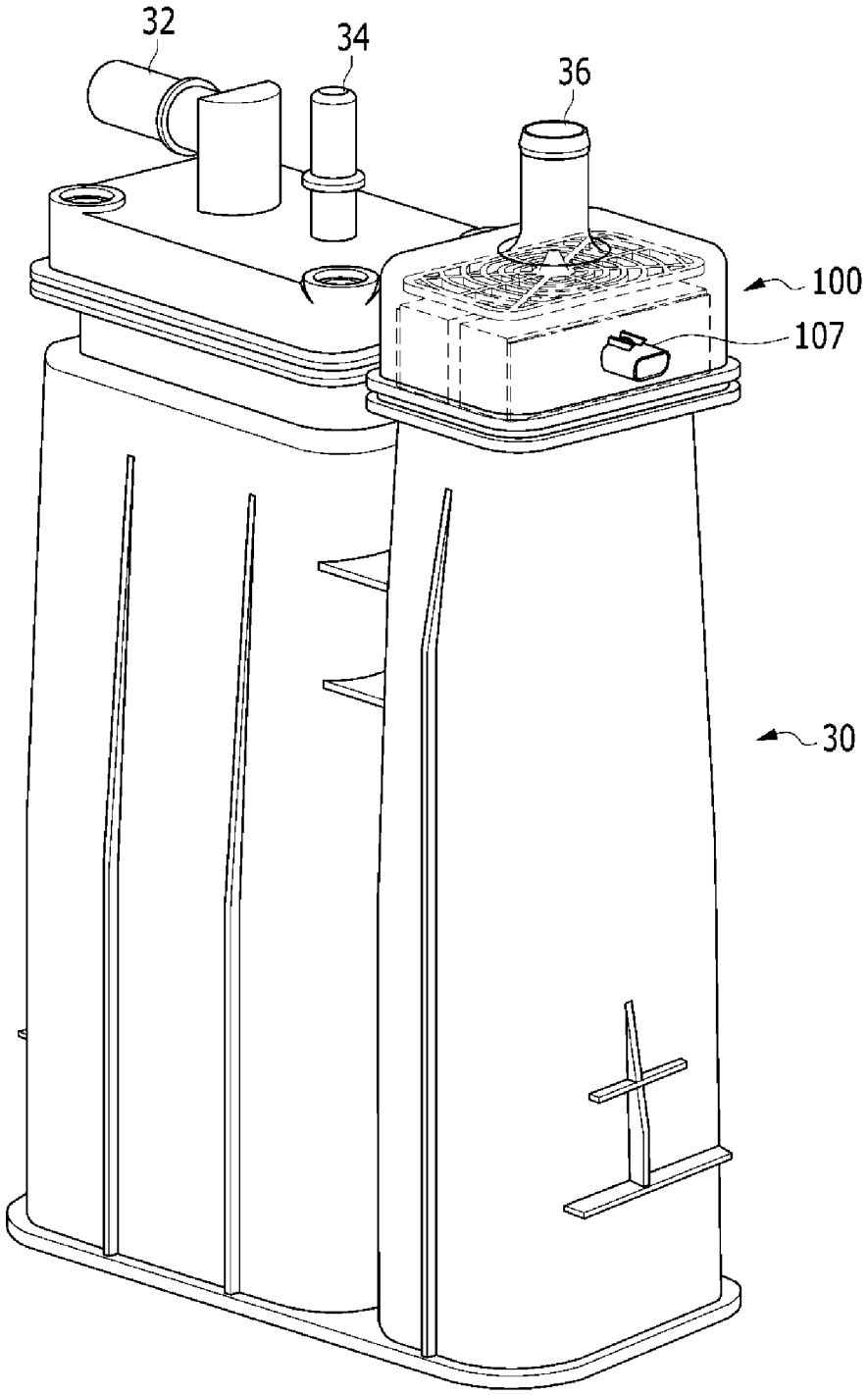
FIG. 2 is a perspective view of an exemplary canister for a vehicle according to the present invention.
Figure 3:
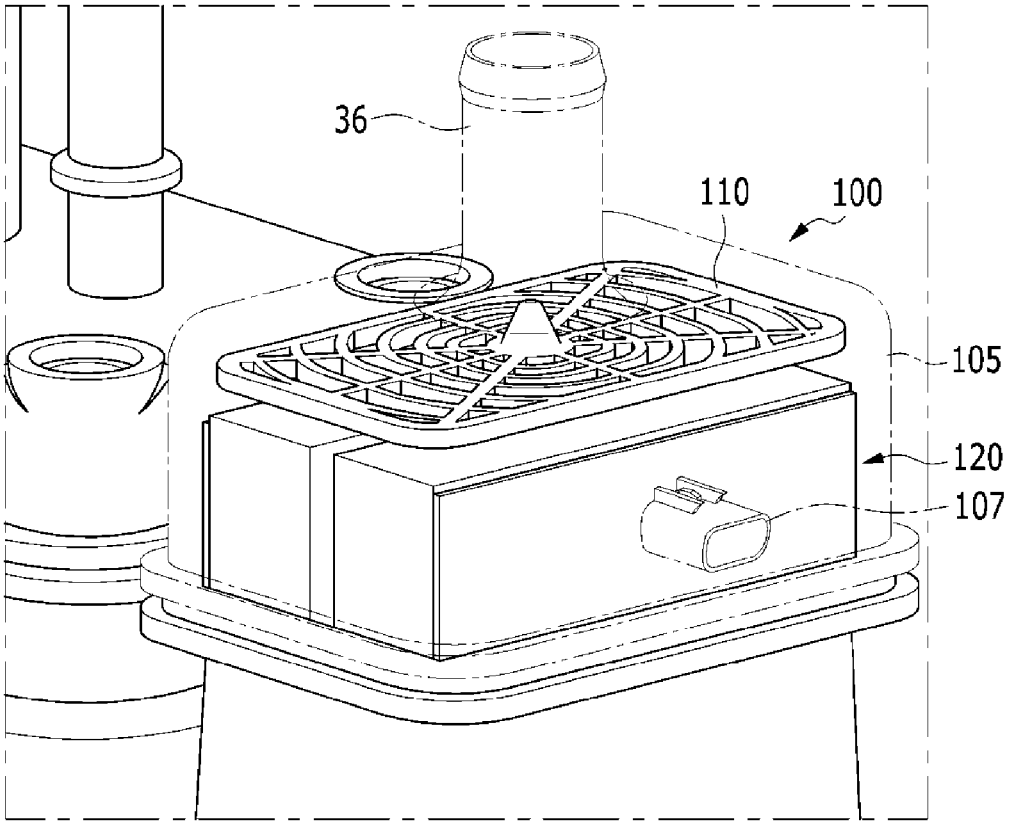
FIG. 3 is an enlarged view of a heating module in FIG. 2.
Figure 4:
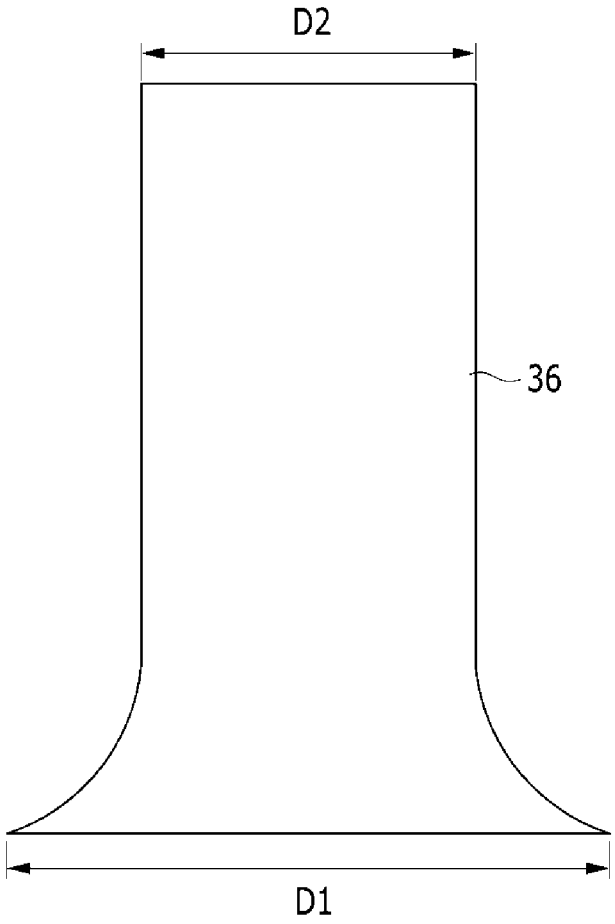
FIG. 4 is a schematic diagram of an air passage in FIG. 2.

As shown in FIG. 2 and FIG. 3, the canister 30 for the vehicle according to various embodiments of the present invention further includes a case 105 mounted between the air passage 36 and the canister 30. That is, the air passing through the air passage 36 is supplied to an inside of the canister 30 through an inside of the case 105. The case 105 is coupled to a main body of the canister 30.

A heating module 100 is mounted in the case 105 and includes a diffusing plate 110 and a heating core 120.

Figure 5:
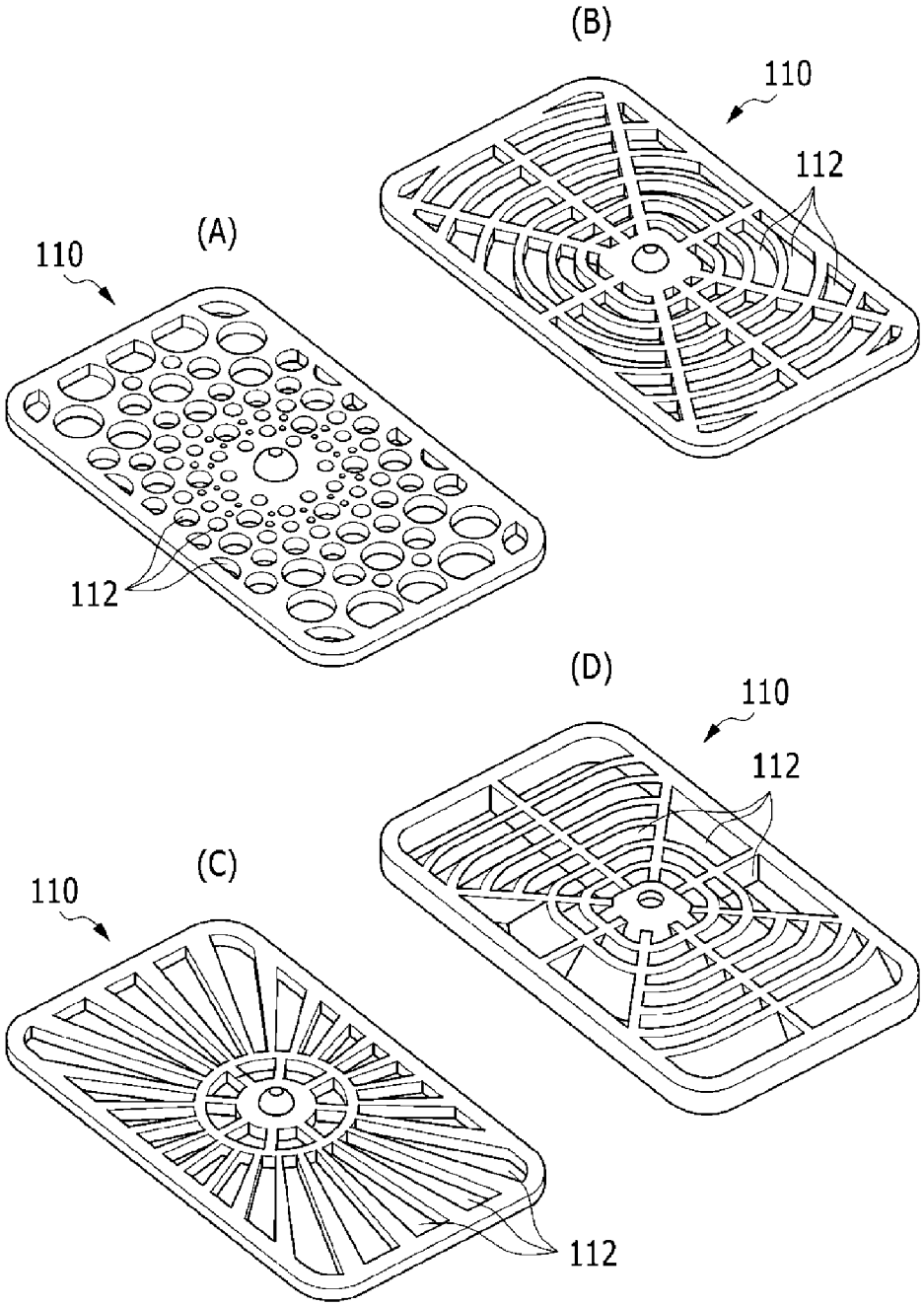
FIG. 5 is a perspective view of various types of diffusing plates used in a canister for a vehicle according to the present invention.

The diffusing plate 110 diffuses the air passing through the air passage 36 so as to be heated at the heating core 120 evenly. As shown in FIG. 5, various types of the diffusing plates 110 can be used, and a plurality of diffusing holes 112 is formed at the diffusing plate 110. The diffusing hole 112, as shown in FIG. 5, may also have various shapes. Shapes of the diffusing plate 110 and diffusing hole 112 are not limited to those shown in FIG. 5.

An exterior circumference of the diffusing plate 110 have almost the same shape as an interior circumference of the case 105 so as to be inserted in the interior circumference of the case 105. A portion of the air passing through the air passage 36 is supplied to the heating module 120 through the diffusing holes 112 of the diffusing plate 110, and the other portion of the air hits the diffusing plate 110 and is dispersed to the surroundings. After that, the other portion of the air is supplied to the heating module 120 through the diffusing holes 112. In addition, the air passage 36 has a shape similar to a diffuser so as to enhance diffusing efficiency of the air. That is, an outlet diameter D1 of the air passage 36 is larger than an inlet diameter D2 of the air passage 36.

The heating module 120 heats the air diffused by the diffusing plate 110 and supplies it into the canister 30. If the heated air is supplied to the inside of the canister 30, the evaporation gas absorbed at the charcoal 38 releases well. Therefore, purge efficiency of the canister 30 may increase, and this is very advantageous to a vehicle such as a hybrid vehicle which has small purge amount. In addition, since the heating module 120 is disposed between the air passage 36 and the canister 30, the evaporation gas absorbed at charcoal near the air passage 36 is firstly released. Accordingly, occurrence of bleed emission may be reduced.

Meanwhile, the heating module 120 is close-contactedly mounted to the case 105. Accordingly, it is prevented that the air passing through the air passage 36 is supplied to the canister 30 after passing through a gap between the heating module 120 and the case 105.

Figure 6:
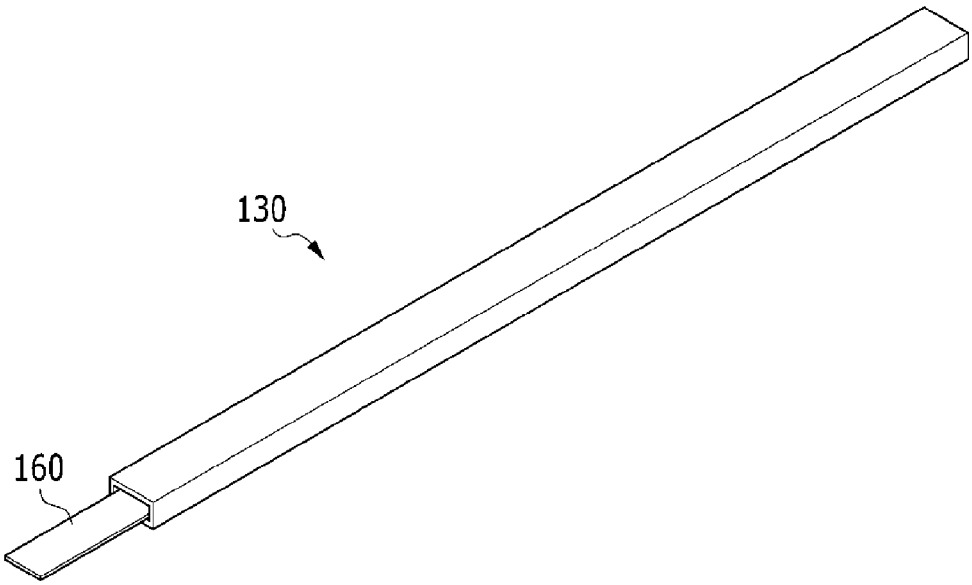
FIG. 6 is a perspective view of an exemplary PTC assembly used in a canister for a vehicle according to the present invention.
Figure 7:
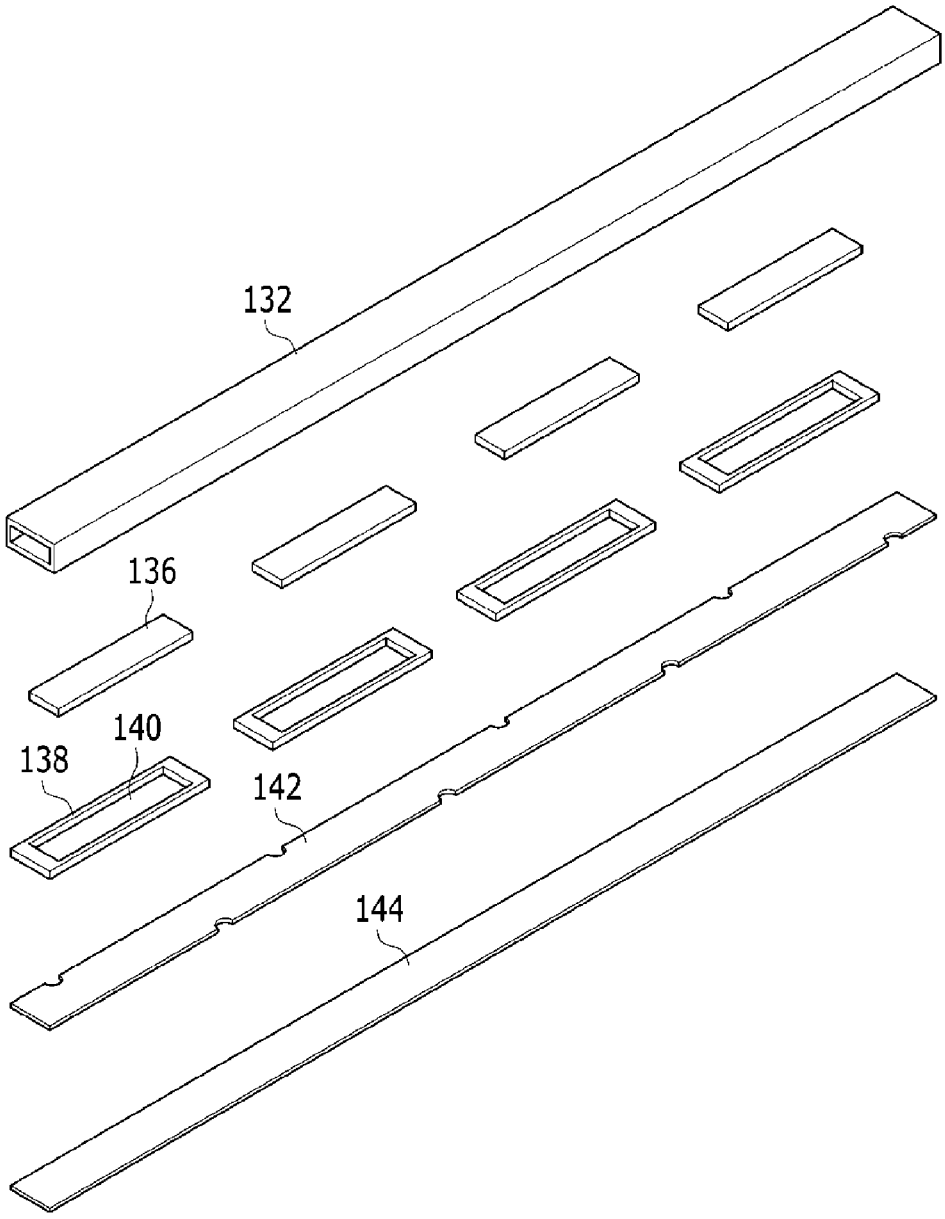
FIG. 7 is an exploded perspective view of an exemplary PTC assembly used in a canister for a vehicle according to the present invention.
Figure 8:
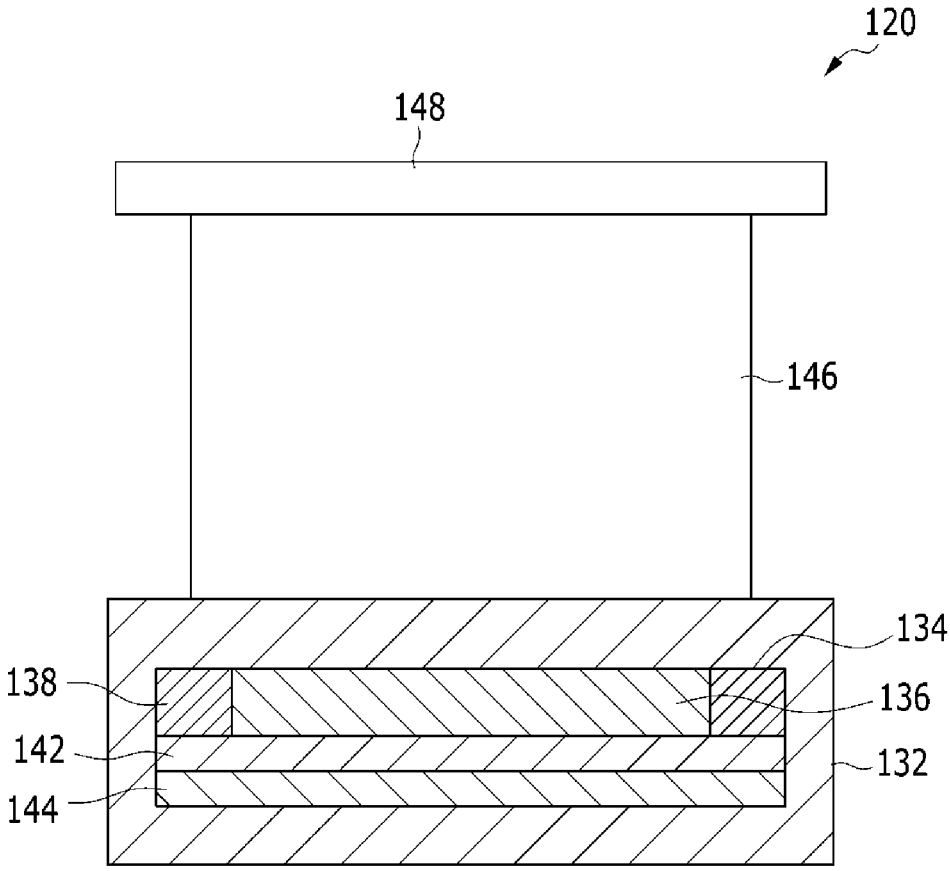
FIG. 8 is a cross-sectional view of an exemplary heating core used in a canister for a vehicle according to the present invention.

As shown in FIG. 6 to FIG. 8, the heating core 120 includes a positive temperature coefficient (PTC) assembly 130 and a fin 146.

The PTC assembly 130 provides heat for heating the air passing through the heating module 120, and includes a rod 132, a PTC frame 138, a PTC element 136, first and second terminals 142 and 148, and an insulator 144.

The rod 132 has hollow rectangular shape in which an inner space 134 is provided. The PTC frame 138, the PTC element 136, the first terminal 142, and the insulator 144 are mounted in the inner space 134 of the rod 132. In addition, the inner space 134 is adapted to be closed and sealed against the evaporation gas when the PTC assembly 130 is mounted at the canister 30. The fin 146 is bonded to a surface of the rod 132.

At least one of PTC frames 138 is mounted in the rod 132. The PTC frame 138 includes a receiving recess 140, and the PTC element 136 is mounted in the receiving recess 140. One PTC element 136 may be mounted in one PTC frame 138, or two or more PTC elements 136 may be mounted in one PTC frame 138.

The PTC element 136 generates heat by receiving electricity. The PTC element 136 is well known to a person of an ordinary skill in the art, and thus detailed description thereof will be omitted.

The first terminal 142 is contacted with the PTC element 136 so as to supply the electricity to the PTC element 136. A connecting portion 160 is formed at one end of the first terminal 142. The connecting portion 160 is protruded from the rod 132 and is connected to a connector fin 154 (referring to FIG. 11). The connector fin 154 is disposed in a connector 107 for receiving the electricity of the vehicle. The first terminal 142 is connected to (+) terminal of a battery directly or indirectly through the connector 107.

Figure 9:
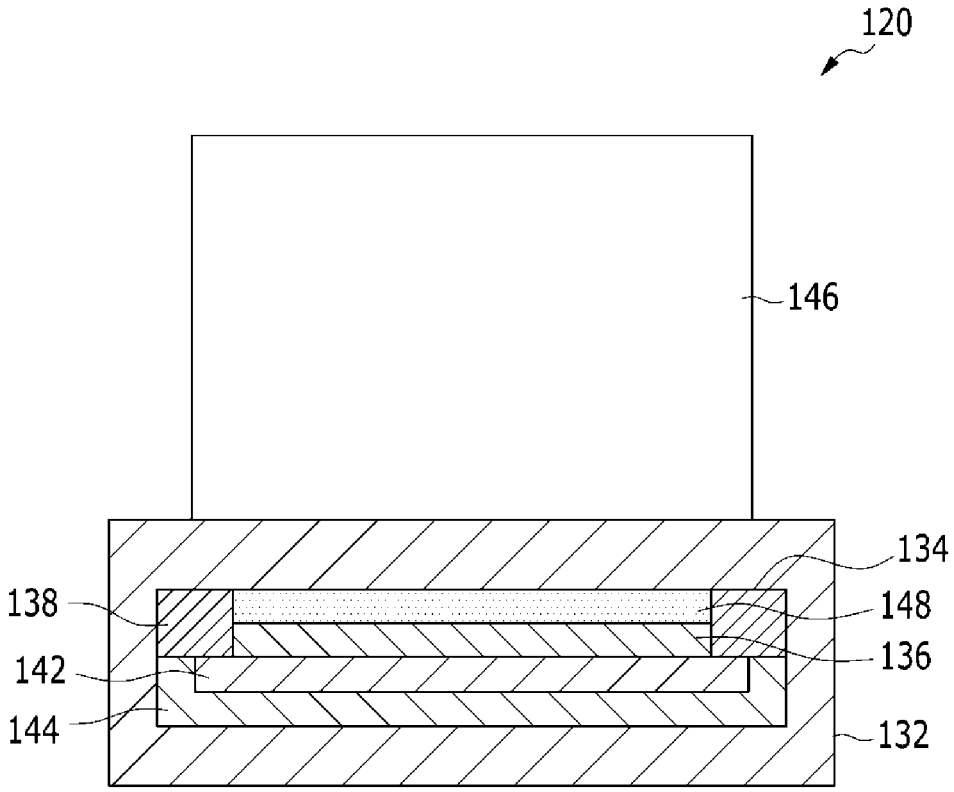
FIG. 9 is a cross-sectional view of an exemplary heating core used in a canister for a vehicle according to the present invention.

The second terminal 148 is attached to the fin 146 and is connected to (−) terminal of the battery or is grounded. Meanwhile, the second terminal 148, as shown in FIG. 9, may be disposed at an inside of the rod 132. That is, the second terminal 148 may be disposed on the PTC element 135.

The insulator 144 is mounted between the first terminal 142 and the rod 132, completely insulates the first terminal 142 from the evaporation gas, the second terminal 148, and the rod 132, is adapted that heat generated by the PTC element 136 is transmitted only to one surface of the rod 132.

Meanwhile, since the rod 132 closes and seals the PTC element 136 and the first terminal 142 against the evaporation gas completely, fire risk due to contact between the evaporation gas and the PTC element 136 or the first terminal 142 may be reduced. Therefore, stability may be enhanced.

The tin 146 receives the heat generated at the PTC assembly 130 and heats the air passing through the heating core 120. In order to realize smooth heat transfer to the air, the fin 146 is formed by mounting a plurality of thin plates with a space to a predetermined direction. It is exemplarily shown that one thin plate is continuously bent so as to form the fin 146 according to various embodiments of the present invention, but the various embodiments of the present invention are not limited to this.

Figure 10:
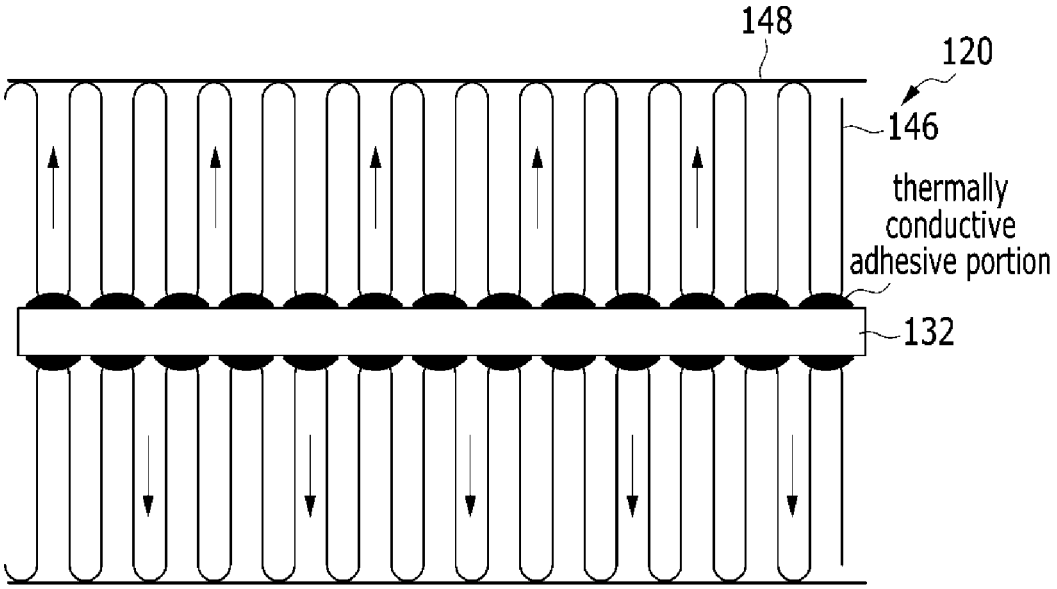
FIG. 10 is a schematic diagram illustrating assembly of an exemplary rod and fin used in a canister for a vehicle according to the present invention.

The fin 146, as shown in FIG. 10, is bonded to the rod 132 by thermally conductive adhesive. In a case that the rod 132 and the fin 146 are bonded by the thermally conductive adhesive, weak force can be applied so as to bond the fin 146 to the rod 132. Therefore, the fin 146 can be formed thinner. If the fin 146 is formed thinner, heat transfer efficiency between the fin 146 and the PTC assembly 130 increases. Therefore, heat generated at the PTC assembly 130 can be transmitted to the air better.

Meanwhile, the second terminal 148 corresponding to the first terminal 142 is bonded to the other surface of the fin 146. One end of the second terminal 142 is connected to the connector fin 154. The second terminal 148 is connected to (−) terminal of the battery or is grounded through the connector 107.

According to various embodiments of the present invention, the air passing through the air passage 36 is diffused by the diffusing plate 110 and is supplied to the heating core 120. At this time, since the outlet diameter D1 of the air passage 36 is larger than the inlet diameter D2 of the air passage 36, speed of the air before flowing into the diffusing plate 110 is reduced and movement of the air is stabilized. The air is further diffused and stabilized when passing through the diffusing plate 110.

The air is heated by the heating core 120 and is supplied to the inside of the canister 30. The air firstly releases the evaporation gas absorbed at the charcoal 38 near the air passage 36. Therefore, occurrence of bleed emission may be reduced.

In addition, the air moves near the purge passage 34 and sequentially releases the evaporation gas absorbed at the charcoal 38 from the air passage 36 to the purge passage 34.

Finally, the air and the released evaporation gas are supplied to the intake passage 12 through the purge passage 34 and the purge line 50.

Figure 11:
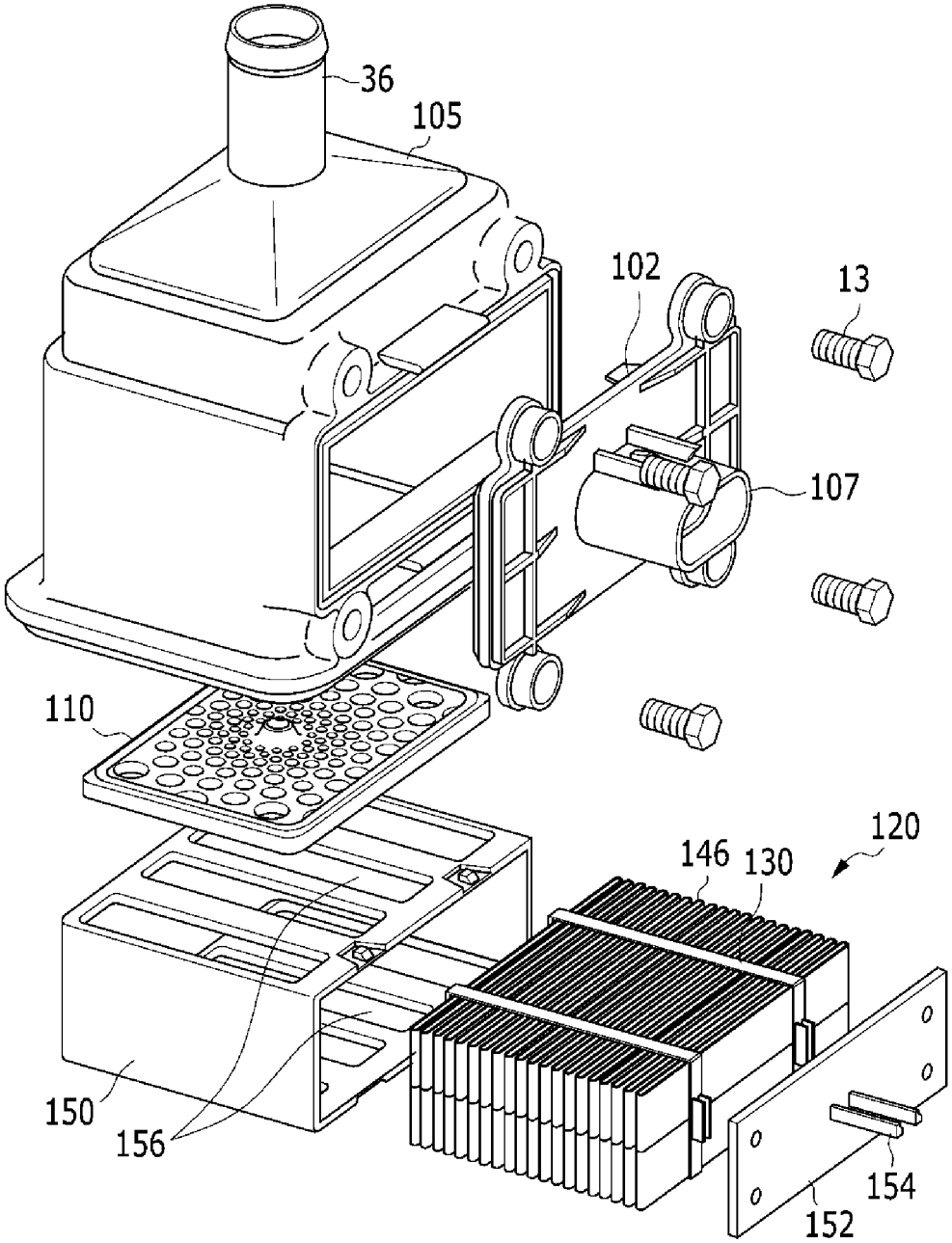
FIG. 11 is an enlarged view of an exemplary heating module used in a canister for a vehicle according to the present invention.
Figure 12:
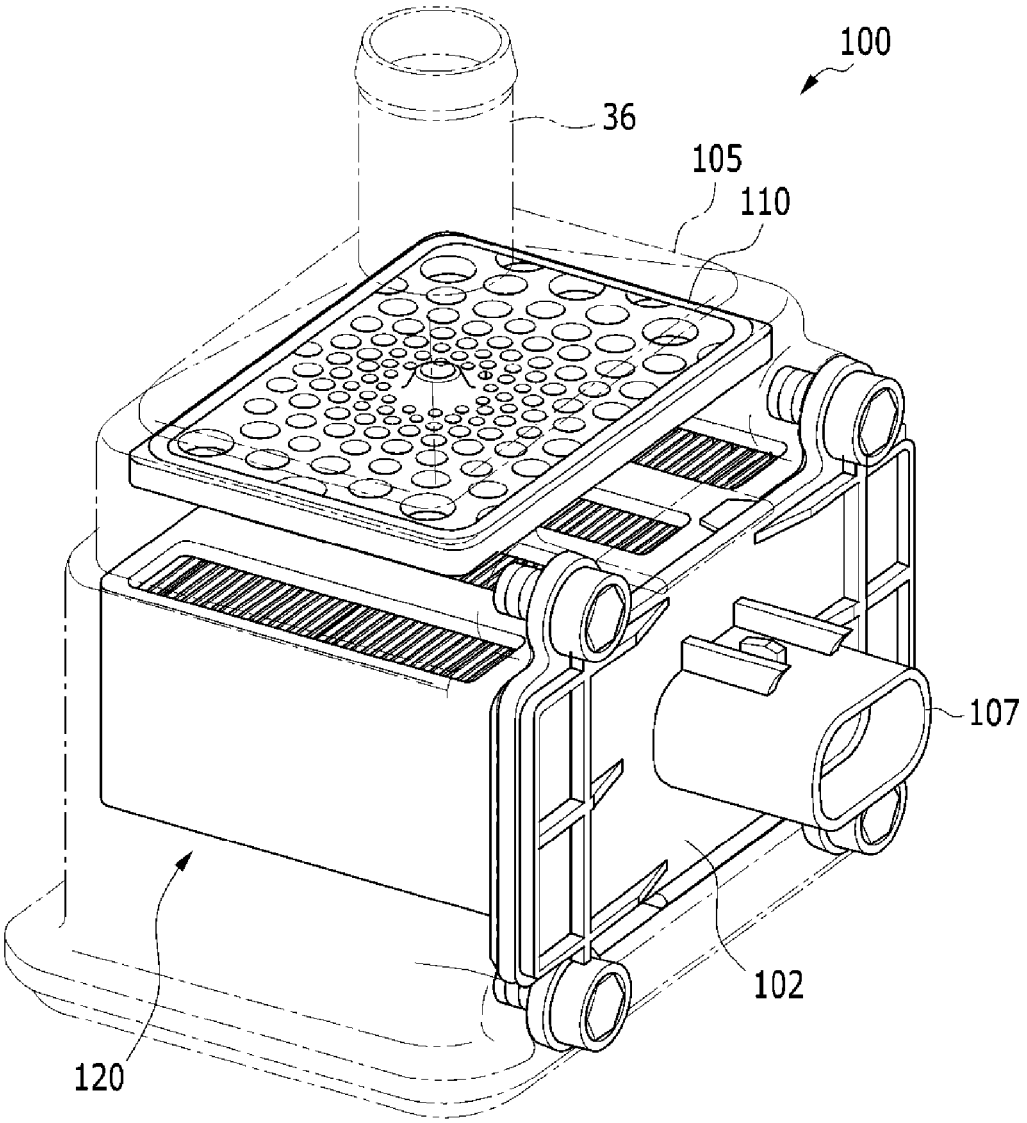
FIG. 12 is an exploded assembly view of a heating module in FIG. 11.
Figure 13:
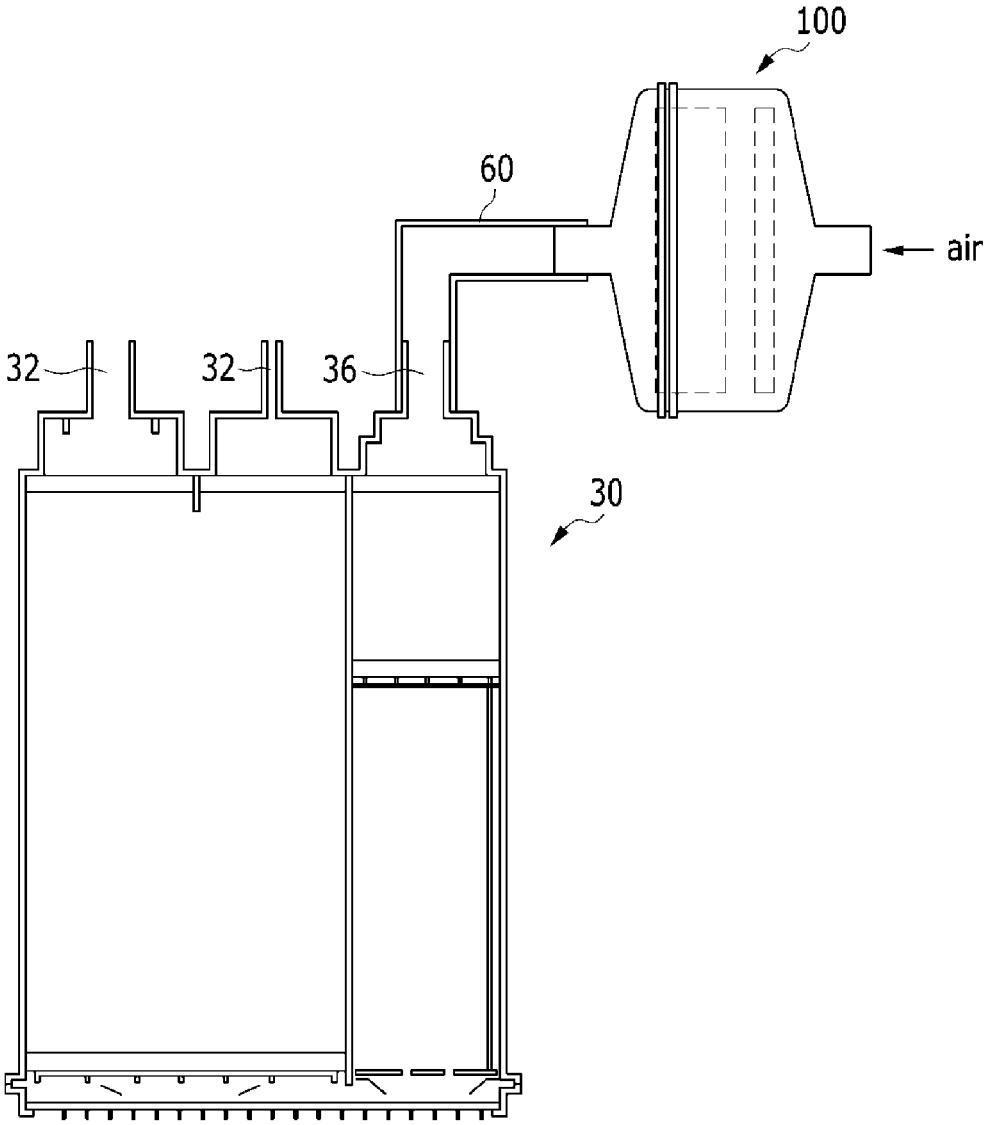
FIG. 13 is a cross-sectional view of an exemplary canister for a vehicle according to the present invention.

As shown in FIG. 11 and FIG. 12, the canister for the vehicle according to various embodiments of the present invention can replaces the heating core 120. That is, one surface of the case 105 is open, and a case cover 102 is assembled to the opened one surface by bolts 13. The connector 107 is formed at the case cover 102.

In addition, the heating core 120 can be inserted in or be pulled out from the case 105 through the opened one surface. For this purpose, the heating core 120 is mounted in the core case 150, and the core case 150 has a size where the core case 150 can be inserted through the opened one surface.

One surface of the core case 150 is open and the heating core 120 may be inserted through the one surface. A printed circuit board (PCB) 152 is coupled to the one surface of the core case 150. The PCB 152 includes a pair of connector fins 154 connected respectively to the first and second terminals 142 and 148 so as to control current applied to the heating core 120, and the connector fins 154 are positioned in the connector 107. In some cases, the PCB 152 may further include a circuit for diagnosing malfunction of the first and second terminals 142 and 138 such as disconnection, short circuit, and so on, a control unit for controlling input voltage of the PTC, and various circuits for controlling the PTC. A plurality of penetration holes are formed at upper and lower surfaces of the core case 150 such that the air passing through the diffusing plate 110 flows into the canister 30 after passing through the fin 146.

According to various embodiments of the present invention, the heating core 120 is inserted in the core case 150 and the PCB 152 is coupled to the one surface of the core case 150. At this time, the first and second terminals 142 and 148 of the heating core 120 are connected respectively to a pair of connector fins 154.

After that, the core case 150 is inserted in the case 105 and the case cover 102 is coupled to the one surface of the case 105 by the bolts 13. In order to prevent moisture from entering the case 105, silicon may be spread or an O-ring may be mounted at coupling portion after the case 105 and the case cover 102 are coupled. At this time, a pair of connector fins 154 are positioned in the connector 107.

If the heating core 120 is out of order, the case cover 102 is detached from the case 105 and the core case 150 is pulled out from the case 105. After that, the heating core 120 can be replaced.

The canister for the vehicle according to various embodiments of the present invention has the many of the same components as those described above. Instead, the heating module 100 is not mounted in the canister 30 but is mounted at the air supply line 60. In this specification, it is to be understood that the air supply line 60 includes the air passage 36.

Since air supplied to a canister is heated, purge efficiency of the canister may be improved and overflow of evaporation gas may be prevented according to exemplary embodiments.

Since the air supplied to the canister is heated, the evaporation gas absorbed at charcoal near an air passage may be firstly released and thereby occurrence of bleed emission may be prevented.

Since the PTC element is disposed in the inner space of a rod which is closed and sealed, fire risk due to contact between the evaporation gas and the PTC element may be reduced.

Since the first terminal supplying electricity to the PTC element is completely insulated in the inner space of the rod which is closed and sealed, safety may be improved.

For convenience in explanation and accurate definition in the appended claims, the terms upper or lower, inside, and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A canister for a vehicle having charcoal therein to absorb evaporation gas evaporated at a fuel tank and release the absorbed evaporation gas according to air supply to supply the evaporation gas to an engine, the canister comprising:

an evaporation gas supply passage connected to the fuel tank and receiving the evaporation gas;

an air passage selectively receiving the air from an exterior;

a purge passage supplying the evaporation gas to the engine according to flow of the supplied air; and a heating module heating a position at which the air passing through the air passage flows in the canister, or mounted at the air passage and heating the air flowing in the canister;

wherein the heating module comprises a heating core for heating the air flowing in the canister, and a diffusing plate disposed between the air passage and the heating module and diffusing the air passing through the air passage to be heated at the heating core evenly.

2. The canister of claim 1, wherein the diffusing plate is a thin plate, and a plurality of diffusing holes is formed at the diffusing plate.

3. The canister of claim 1, wherein the heating core comprises:

a positive temperature coefficient (PTC) assembly generating heat according to a supply of electricity; and a fin having a surface fixed to the PTC assembly, and heating the air flowing into the canister by transferring heat generated at the PTC assembly to the air.

4. The canister of claim 3, wherein the fin is fixed to the PTC assembly by a thermally conductive adhesive.

5. The canister of claim 3, wherein the PTC assembly comprises:

a hollow rod formed with an inner space therein;

a PTC element inserted in the inner space and generating heat according to the supply of the electricity; and a first terminal mounted in the inner space, and configured to contact with the PTC element and supply the electricity to the PCT element.

6. The canister of claim 5, wherein the PTC assembly is insertedly mounted in a receiving recess formed at a PTC frame.

7. The canister of claim 5, wherein an insulator is mounted between the first terminal and the hollow rod.

8. The canister of claim 5, wherein the heating core further comprises a second terminal fixed to the other surface of the fin and corresponding to the first terminal.

9. The canister of claim 5, wherein the heating core further comprises a second terminal mounted at an opposite side of the first terminal with reference to the PTC element in the inner space, and configured to contact with the PTC element.

10. The canister of claim 1, wherein diameter of an outlet is larger than that of an inlet in the air passage.

11. The canister of claim 1, wherein the diffusing plate and the heating module are replaceably mounted in a case formed at an upper end of one side of the canister and connected to the air passage.

12. The canister of claim 11, further comprising a case cover;

wherein one surface of the case is open, and the case cover is detachably coupled to the opened one surface such that the diffusing plate and the heating module are pulled out from the case through the opened one surface.

13. A fuel evaporative system comprising:

a fuel tank connected to a refueling line to receive fuel, exhausting internal evaporation gas through a evaporation gas line, and supplying the fuel through a fuel supply line;

an engine connected to the fuel supply line to receive the fuel from fuel tank, and connected to an intake passage to receive air;

a purge line connected to the intake passage; and a canister provided with charcoal therein for absorbing evaporation gas, and having an evaporation gas supply passage connected to the evaporation gas line to receive the evaporation gas, an air passage connected to an air supply line to receive exterior air, a purge passage connected to the purge line and releasing the evaporation gas absorbed at the charcoal according to flow of the air supplied through the air passage to supply the evaporation gas to the intake passage, and a heating module heating a position into which the air passing through the air passage flows or mounted at the air supply line and heating the air;

wherein the heating module comprises a heating core for heating the air flowing in the canister, and a diffusing plate disposed between the air passage and the heating module and diffusing the air passing through the air passage to be heated at the heating core evenly.

14. The fuel evaporative system of claim 13, wherein the diffusing plate is a thin plate, and a plurality of diffusing holes is formed at the diffusing plate.

15. The fuel evaporative system of claim 13, wherein the heating core comprises:

a positive temperature coefficient (PTC) assembly generating heat according to supply of electricity; and a fin having a surface fixed to the PTC assembly, and heating the air flowing into the canister by transferring heat generated at the PTC assembly to the air.

16. The fuel evaporative system of claim 15, wherein the fin is fixed to the PTC assembly by thermally conductive adhesive.

17. The fuel evaporative system of claim 15, wherein the PTC assembly comprises:

a hollow rod formed of an inner space therein;

a PTC frame inserted in the inner space and formed of a receiving recess;

a PTC element inserted mounted in the receiving recess and generating heat according to the supply of the electricity; and a first terminal mounted in the inner space, and adapted to contact with the PTC element and supply the electricity to the PCT element.

18. The fuel evaporative system of claim 17, wherein an insulator is mounted between the first terminal and the hollow rod.

19. The fuel evaporative system of claim 17, wherein the heating core further comprises a second terminal fixed to the other surface of the fin and corresponding to the first terminal.

20. The fuel evaporative system of claim 17, wherein the heating core further comprises a second terminal mounted at an opposite side of the first terminal with reference to the PTC element in the inner space, and adapted to contact with the PTC element.

* * * * *